US009867464B1

(12) United States Patent
Kokenge

(10) Patent No.: US 9,867,464 B1
(45) Date of Patent: Jan. 16, 2018

(54) SHELF LOCATOR INSERTS AND SHELF INSERT SYSTEMS THEREOF FOR LOCATING SHELVES

(71) Applicant: Organized Living, Inc., Cincinnati, OH (US)

(72) Inventor: John Kokenge, Cincinnati, OH (US)

(73) Assignee: Organized Living, Inc., Cincinnati, OH (US)

( * ) Notice: Subject to any disclaimer, the term of this patent is extended or adjusted under 35 U.S.C. 154(b) by 0 days.

(21) Appl. No.: 15/358,784

(22) Filed: Nov. 22, 2016

(51) Int. Cl.

| | |
|---|---|
| ***A47G 29/02*** | (2006.01) |
| ***A47B 96/02*** | (2006.01) |
| ***A47B 96/06*** | (2006.01) |
| ***A47B 96/07*** | (2006.01) |
| ***A47B 57/42*** | (2006.01) |
| ***F16B 47/00*** | (2006.01) |

(52) U.S. Cl.
CPC ..... *A47B 96/028* (2013.01); *A47B 57/42* (2013.01); *A47B 96/061* (2013.01); *A47B 96/07* (2013.01); *F16B 47/003* (2013.01)

(58) Field of Classification Search
CPC ..... A47B 96/028; F16B 47/003
USPC ..... 248/235, 250; 108/107, 108, 152
See application file for complete search history.

(56) References Cited

U.S. PATENT DOCUMENTS

| | | | | | |
|---|---|---|---|---|---|
| 2,534,952 | A | * | 12/1950 | Comer | A47B 57/42 108/107 |
| 3,199,822 | A | * | 8/1965 | Ruhnke | A47B 96/028 248/243 |
| 4,299,367 | A | * | 11/1981 | Harlan | A47B 96/061 248/223.41 |
| 4,431,155 | A | * | 2/1984 | Engel | A47B 96/061 108/108 |
| 4,738,426 | A | * | 4/1988 | Bessinger | A47K 1/08 108/152 |
| 4,863,127 | A | * | 9/1989 | Handler | A47B 57/06 248/205.2 |
| 5,069,408 | A | * | 12/1991 | Bessinger | A47B 96/061 108/108 |
| 5,404,822 | A | * | 4/1995 | Jaskiewicz | A47B 96/062 108/108 |

OTHER PUBLICATIONS

Organized Living freedomRail Shelf Locators, Date: prior to filing of application, 3 pages.

* cited by examiner

*Primary Examiner* — Gwendolyn Baxter
(74) *Attorney, Agent, or Firm* — Dinsmore & Shohl LLP

(57) ABSTRACT

A shelf locator insert includes an insertable portion including a leg member and a head portion located over the leg member. A tacky layer is located on the head portion. An engagement fin is provided along the leg member. The insertable portion is configured to be received within a channel of a shelf support bracket such that the engagement fin interfaces with an interior wall of the shelf support bracket to friction fit the shelf locator insert in the shelf support bracket.

19 Claims, 6 Drawing Sheets

SHELF LOCATOR INSERTS AND SHELF INSERT SYSTEMS THEREOF FOR LOCATING SHELVES

TECHNICAL FIELD

The present specification generally relates to shelf locator inserts and shelf locating systems including the shelf locator inserts for locating shelves.

BACKGROUND

Shelving is used to store and display items. Shelves are usually supported by brackets that may be attached to a support structure, such as a wall. Typically, shelves are connected to the brackets with the help of screws that are screwed into the shelf through an opening in the support bracket. Because the opening in the support bracket is at a predetermined, fixed location, precise alignment between the shelf and the opening may be needed. There exists a need for readily adjustable shelving, where the shelves may be easily detached from the support brackets.

SUMMARY

In one embodiment, a shelf locator insert includes an insertable portion including a leg member and a head portion located over the leg member. A tacky layer is located on the head portion. An engagement fin is provided along the leg member. The insertable portion is configured to be received within a channel of a shelf support bracket such that the engagement fin interfaces with an interior wall of the shelf support bracket to friction fit the shelf locator insert in the shelf support bracket.

In another embodiment, a shelf locating system includes a shelf support bracket including a base portion for attachment with an upright support structure. An arm portion extends from the base portion. A channel is located within the arm portion. The channel has an interior wall. A shelf locator insert is configured to be received within the channel of the shelf support bracket. The shelf locator insert including a frame including an insertable portion and a head portion located over the insertable portion. A tacky layer is located on the head portion of the frame. An engagement fin extends along a length of the insertable portion. The engagement fin interfaces with the interior wall of the shelf support bracket to fit the shelf locator insert into the channel.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments disclosed herein are generally related to shelving systems and more specifically to shelf locator inserts and shelf locating systems including shelf locator inserts for removably coupling shelves to shelving supports. The shelf locator inserts generally include an insertable portion that is insertable into a channel of a shelf support bracket and an enlarged head portion that overhangs opposing walls of the shelf support bracket. The shelf locator insert can be used in a shelf locating system including the shelf support bracket, an upright support structure, a rail support structure (e.g., wall mounted frame), and a shelf. The shelf support bracket is removably attached to the upright support structure. The shelf locator insert is inserted within the channel of the shelf support bracket. The shelf is located above the shelf support bracket and the shelf locator insert. The shelf locator insert precisely and selectively locates the shelf on the shelf support bracket. The shelf locator insert can be provided with a tacky layer that removably couples the shelf to the shelf locator insert, and in turn to the shelf support bracket. By removably attaching the shelf to the shelf support bracket with the shelf locator insert, shelving may be adjusted and readjusted to the changing needs of a user.

Figure 1:
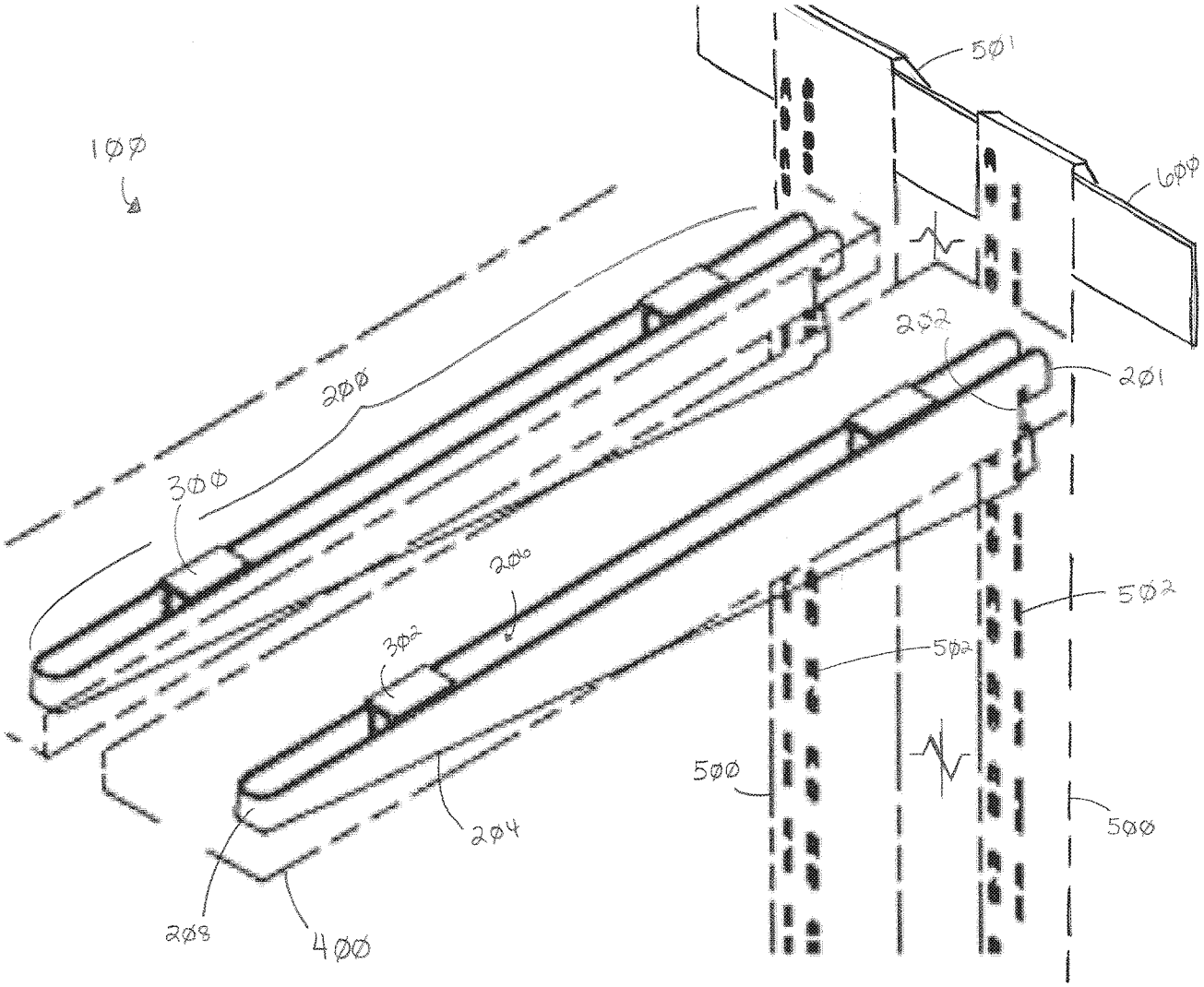
FIG. 1 depicts a shelf locating system including a shelf support bracket, a shelf locator insert, a shelf and an upright support structure, according to one or more embodiments shown and described herein.

Referring to FIG. 1, a shelf locating system 100 is shown, and includes a shelf support bracket 200, shelf locator inserts 300 and a shelf 400. Further, the shelf locating system 100 includes an upright support structure 500, where the shelf support bracket 200 is attached to the upright support structure 500 and a rail support structure 600. In one nonlimiting embodiment, the rail support structure 600 may be coupled to a wall using screws, bolts, nails or any other suitable means. The upright support structure 500 may be removably coupled to the rail support structure 600 using an upright support hook 501. The upright support structure 500 may be a frame member having slots 502 for receiving bracket hooks 201 of the shelf support bracket 200 for hanging the shelf support bracket 200 thereon at a desired location. The shelf support bracket 200 may include a base portion 202 and an elongated arm portion 204. The upright support structure 500 may connect a wall, door, frame or any such structure where shelving may be desired.

Still referring to FIG. 1, the base portion 202 extends in a vertical direction for attachment with the upright support structure 500. While only two upright support structures 500 and shelf support brackets 200 are illustrated, generally there may be several upright support structures 500 removably connected to a single rail support structure 600. Likewise, there may be several shelf support brackets 200 removably connected to the one or several upright support structures 500. The shelf support bracket 200 may include the arm portion 204 extending horizontally outward from the base portion 202. In some embodiments, the arm portion 204 may extend in a direction perpendicular to the base portion 202. In some embodiments, the dimensions of the shelf support bracket 200, such as a height of the base portion 202 and a length of the arm portion 204 may be chosen such that the shelf support bracket 200 is able to support a predetermined weight on the shelf 400.

The shelf support bracket 200 may include a U-shaped channel 206 that extends between the base portion 202 and a free end 208 of the arm portion 204. The shelf locator insert 300 may be repeatedly removed and inserted into the channel 206 at various locations along a length of the channel 206. Certain embodiments of the shelf locator insert 300 may include a tacky layer 302 such that when the shelf 400 is placed over the shelf support bracket 200 and the shelf locator insert 300, the tacky layer 302 releasably affixes the shelf 400 to the shelf locator insert 300 and the shelf locator insert 300 frictionally engages the shelf support bracket 200 within the channel 206.

Figure 2:
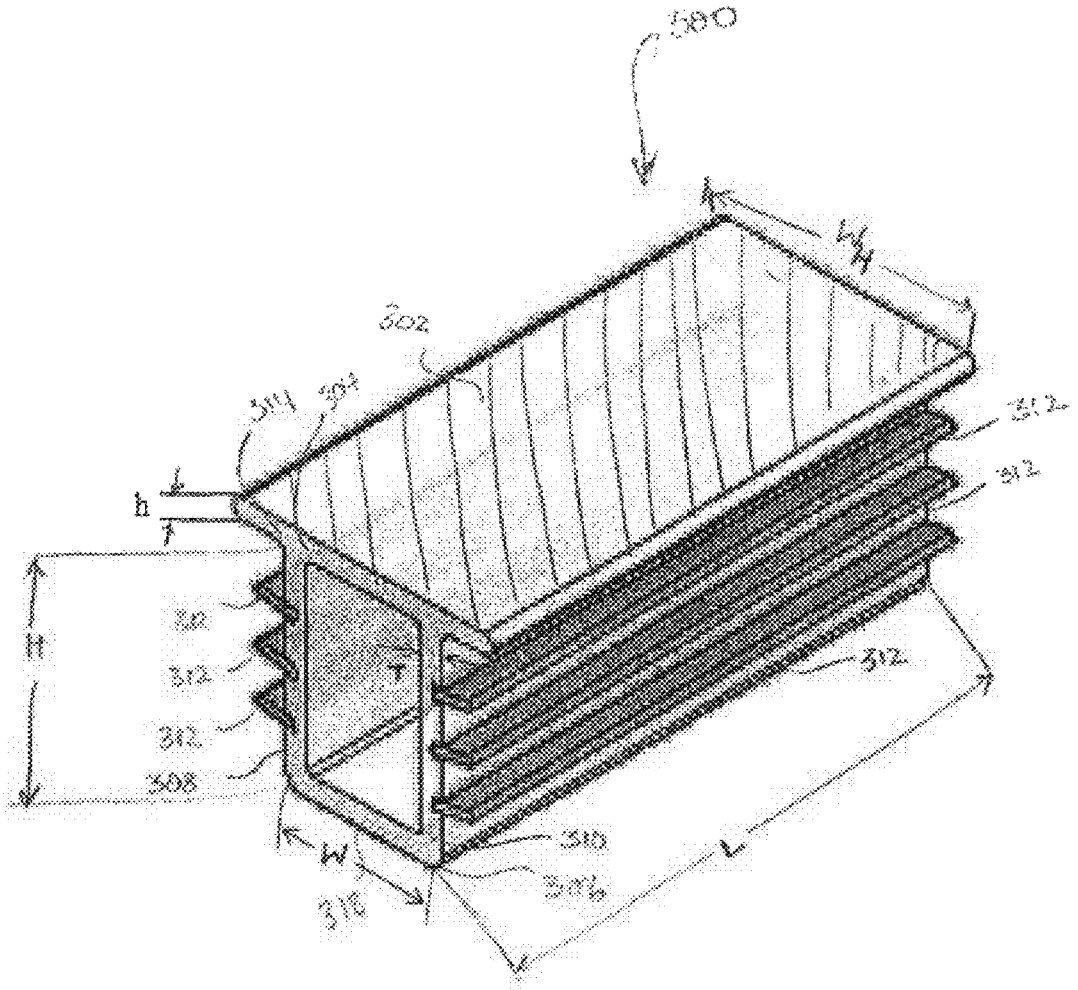
FIG. 2 depicts a perspective view of a shelf locator insert, according to one or more embodiments shown and described herein.

Referring now to FIG. 2, the shelf locator insert 300 includes a frame 314 having the head portion 304 and the insertable portion 306. The insertable portion 306 includes a first leg member 308 and a second leg member 310 spaced apart from the first leg member 308. The insertable portion 306 is sized and shaped to be inserted into the channel 206 of the shelf support bracket 200, as discussed above. In some embodiments, the first leg member 308 and the second leg member 310 are spaced apart with a base member 318 between them. In some embodiments, the first leg member 308 and the second leg member 310 are substantially parallel to each other. In other embodiments, a distance between the first leg member 308 and the second base member may gradually increase or decrease from the head portion 304 of the frame 314 toward the base member 318 of the frame 314. Other shapes for the insertable portion 306 may be used depending on the shape of the channel 206. In example embodiments, the shelf locator insert 300 may not have a base member 318 such that first leg member 308 and second leg member 310 are connected only at the head portion 304 or the base member 318 may be rounded instead of flat as shown.

The first leg member 308 and the second leg member 310 each have a length (L) and a height (H). Further, in embodiments, the length (L) and the height (H) of each of the first and second leg members 308, 310 are substantially equal. In some embodiments, the length (L) of the first leg member 308 and the second leg member 310 are such that multiple shelf locator inserts 300 may be placed along the length of the channel 206 of the shelf support bracket 200. In exemplary embodiments, the length (L) of the first leg member 308 and the second leg member 310 may be within a range of about 0.5 inches to about 3 inches, or about 1 inch to about 2.5 inches, or about 1.5 inches to about 2 inches. In non-limiting examples, the height (H) of the shelf locator insert 300 may be within a range of about 0.2 inches to about 2 inches, or about 0.3 inches to about 1 inch, or about 0.4 inches to about 0.6 inches. Additionally, in embodiments, a thickness (T) of each of the first leg member 308 and the second leg member 310 may be within a range of about 0.2 inches to about 1 inches, or about 0.3 inches to about 0.8 inches, or about 0.4 inches to about 0.6 inches. Further, in exemplary embodiments, the base member 318 may have a width (W), where the width (W) is within a range of about 0.1 inches to about 1 inch, or about 0.2 inches to about 0.8 inches, or about 0.3 inches to about 0.6 inches. While FIG. 2 shows the frame 314 of the shelf locator insert 300 to be hollow, in example embodiments, the frame 314 may be solid.

Still referring to FIG. 2, the head portion 304 extends over the insertable portion 306, that is, the first leg member 308 and the second leg member 310. In some embodiments, the head portion 304 may extend beyond the first leg member 308 and the second leg member 310 of the insertable portion 306, such that the head portion 304 fits over the channel 206 of the shelf support bracket 200 when the shelf locator insert 300 is inserted into the shelf support bracket 200. In some embodiments, the head portion 304 has a head portion width ($W_H$) that is greater than the base member width (W). In embodiments, the head portion width ($W_H$) is within a range of about 0.2 inches to about 3 inches, or about 0.4 inches to about 2 inches, or within 0.5 inches to about 1 inch. In exemplary embodiments, the head portion 304 has a head portion height (h) within a range of about 0.01 inches to about 0.5 inches, or about 0.02 to about 0.2 inches, or about 0.03 inches to about 0.1 inches, or about 0.04 inches to about 0.05 inches.

In some embodiments, the frame 314 is made of a first material. The first material may be a rigid plastic such as 60 Durometer fusible PVC. Other plastics may be used. Further, in non-limiting exemplary embodiments, the frame 314, that is the head portion 304 and the insertable portion 306 may be extruded.

Figure 3:
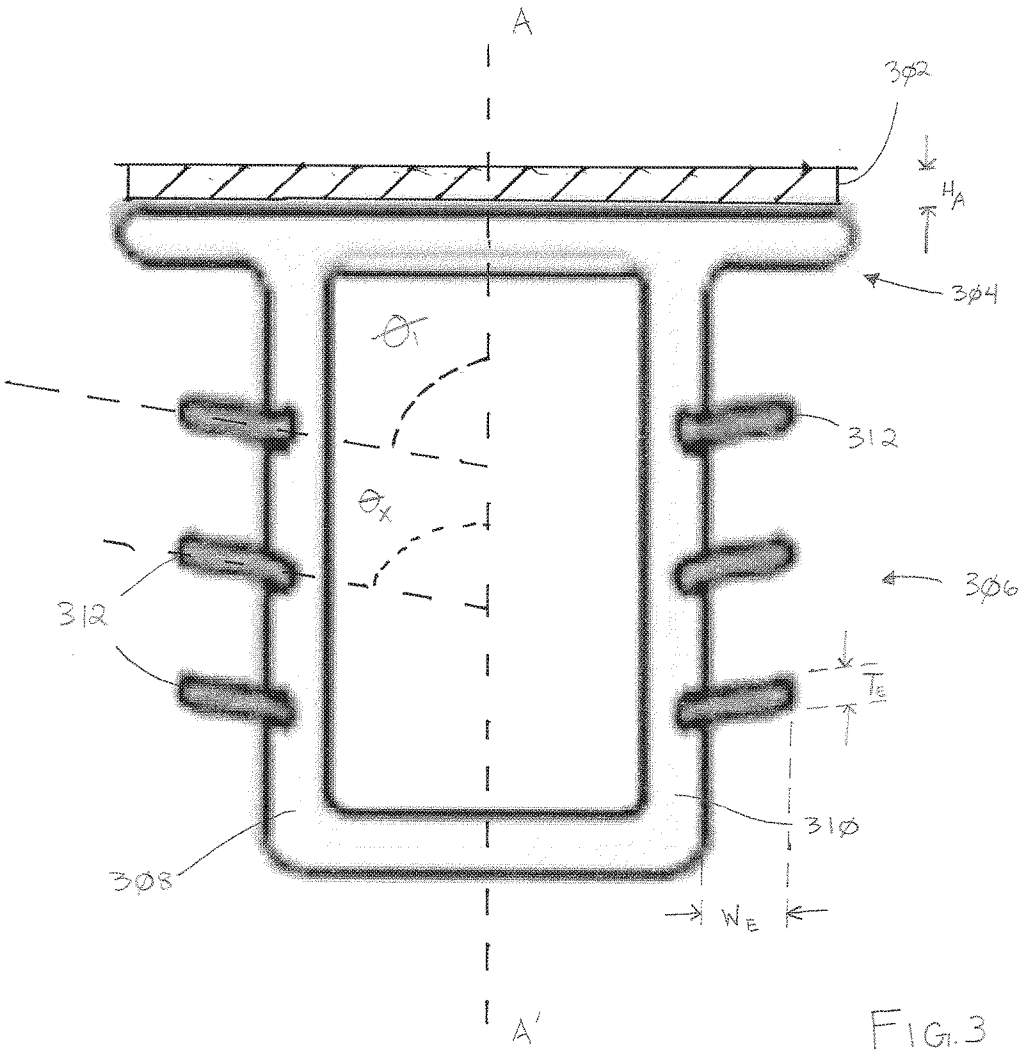
FIG. 3 is a cross sectional view of the shelf locator insert of FIG. 2, according to one or more embodiments shown and described herein.

Referring now to FIGS. 2 and 3 collectively, the tacky layer 302 is located over the head portion 304 of the frame 314. In embodiments, the tacky layer 302 extends throughout the head portion 304. In other embodiments, the tacky layer 302 extends discontinuously over the head portion 304. In some embodiments, the tacky layer 302 may be made of adhesives such as solvent-based adhesives, polymer dispersion adhesives or emulsion adhesives, pressure sensitive adhesives, removable adhesives, contact adhesives or non-adhesives, such as tacky plastic materials, and the like. In exemplary embodiments, the tacky layer 302 is configured to form a temporary bond, and can be removed, even after an extended period of time (days, months, or years) without leaving residue on the shelf 400 when placed over the tacky layer 302 of the shelf locator insert 300. In some embodiments, the tacky layer 302 is an acrylic hi-bond adhesive tape.

In some embodiments, the tacky layer 302 may be configured to stick and un-stick to the shelf 400 placed over the shelf locator insert 300 by the application of a removal tensile force. In embodiments, the tacky layer 302 may be replaced to allow the shelf locator insert 300 to be re-used. In exemplary embodiments, a tacky layer height ($H_A$) is within a range of about 0.01 inches to about 1 inch, or about 0.02 inches to about 0.09 inches, or about 0.03 inches to about 0.05 inches. In non-limiting examples, the tacky layer 302 may be covered with a protective sheet which may be peeled off to removably attach the shelf 400 to the shelf locator insert 300.

Referring to FIGS. 2 and 3 collectively, the insertable portion 306 of the shelf locator insert 300 further includes at least one engagement fin 312. In certain embodiments, at least one engagement fin 312 is attached to one or more of the first leg member 308 and second leg member 310. In some embodiments, the engagement fin 312 may extend along the entire length (L) of the first and/or second leg member 308, 310 or may extend only a portion thereon. In certain embodiments, the engagement fin 312 is not continuous along the entire length (L) of the first and/or second leg member, but may proceed along the length (L) discontinuously with one or multiple sections forming a fin along the length (L) of the first and/or second leg member 308, 310. In some embodiments, one or more engagement fins may extend along the height (H) of each of the first leg member 308 and the second leg member 310. The engagement fins may extend in other patterns, such as waves or any other suitable shape or may generally extend as one line comprising a series of hashmarks along the length (L). In exemplary embodiments, between two and five engagement fins 312, such as three as illustrated may be extend along the first leg member 308 and the second leg member 310 in a substantially parallel fashion and evenly spaced along the height (H) of the first and second leg members 308, 310.

Referring to FIG. 3, as a non-limiting example, each engagement fin 312 has an engagement fin thickness ($T_E$), where the engagement fin thickness ($T_E$) is within a range of about 0.01 inches to about 1 inch, or about 0.02 inches to about 0.1 inches, or about 0.02 inches to about 0.05 inches. Further, in exemplary embodiments, a spacing between a first engagement fin 312 and a second engagement fin 312 on a first leg member 308 or second leg member 310 is within a range of about 0.05 inches to about 0.15 inches, or 0.05 inches to about 0.1 inches, or about 0.09 inches to about 0.1 inches. Additionally, in embodiments, each engagement fin 312 may be partially encapsulated within plastic of the first and second leg members 308, 310 and extend outward and away therefrom by a width ($W_E$) as shown in FIG. 3. In embodiments, the width ($W_E$) may be within a range of about 0.01 inches to about 0.1 inches, or about 0.04 inches to about 0.08 inches or about 0.05 inches to about 0.07 inches.

As shown in FIG. 3, each engagement fin 312 may be positioned at an angle (θ) from a central axis A of the shelf locator insert 300. The central axis A of the shelf locator insert 300 is perpendicular to the base member 318 and/or head portion 304. In example embodiments, one or more engagement fins 312 may be positioned at the angle ($\theta_1$) of less than about 90 degrees, such as between about 45 degrees about 85 degrees, such as about 80 degrees from the central axis A. While FIG. 3 shows the engagement fins 312 to be angled upward towards the head portion 304, in some embodiments, the engagement fins 312 may be angled downward towards the base member 318 or parallel to the base member 318. Additionally, as shown in FIG. 3, each engagement fin 312 may be positioned at its own individual angle ($\theta_x$). The individual engagement fin 312 angles ($\theta_1$, $\theta_2$, $\theta_x$, etc.) are chosen such that the shelf locator insert 300 is able to retain itself within the channel 206 due to the engagement fins 312 interfacing with interior walls 210, 212 of the shelf support bracket 200, thereby inhibiting unintended removal of the shelf locator insert 300 from the channel 206 while providing for removal of the shelf 400 when the user so chooses.

In certain embodiments, the engagement fins 312 may made from a different material that is a more flexible than the material used for the insertable portion 306 of the frame 314. The second material may also be a resilient material to allow for reuse of the shelf locator insert 300. In embodiments, the second material is made of materials such as flexible plastics, rubber, etc. In other embodiments, the engagement fins 312 and the frame 314 may be formed of the same material. The engagement fins 312 and the frame 314 may be formed by a coextrusion process where the engagement fins 312 and frame 314 are formed simultaneously from two different materials having different hardnesses.

Figure 4:
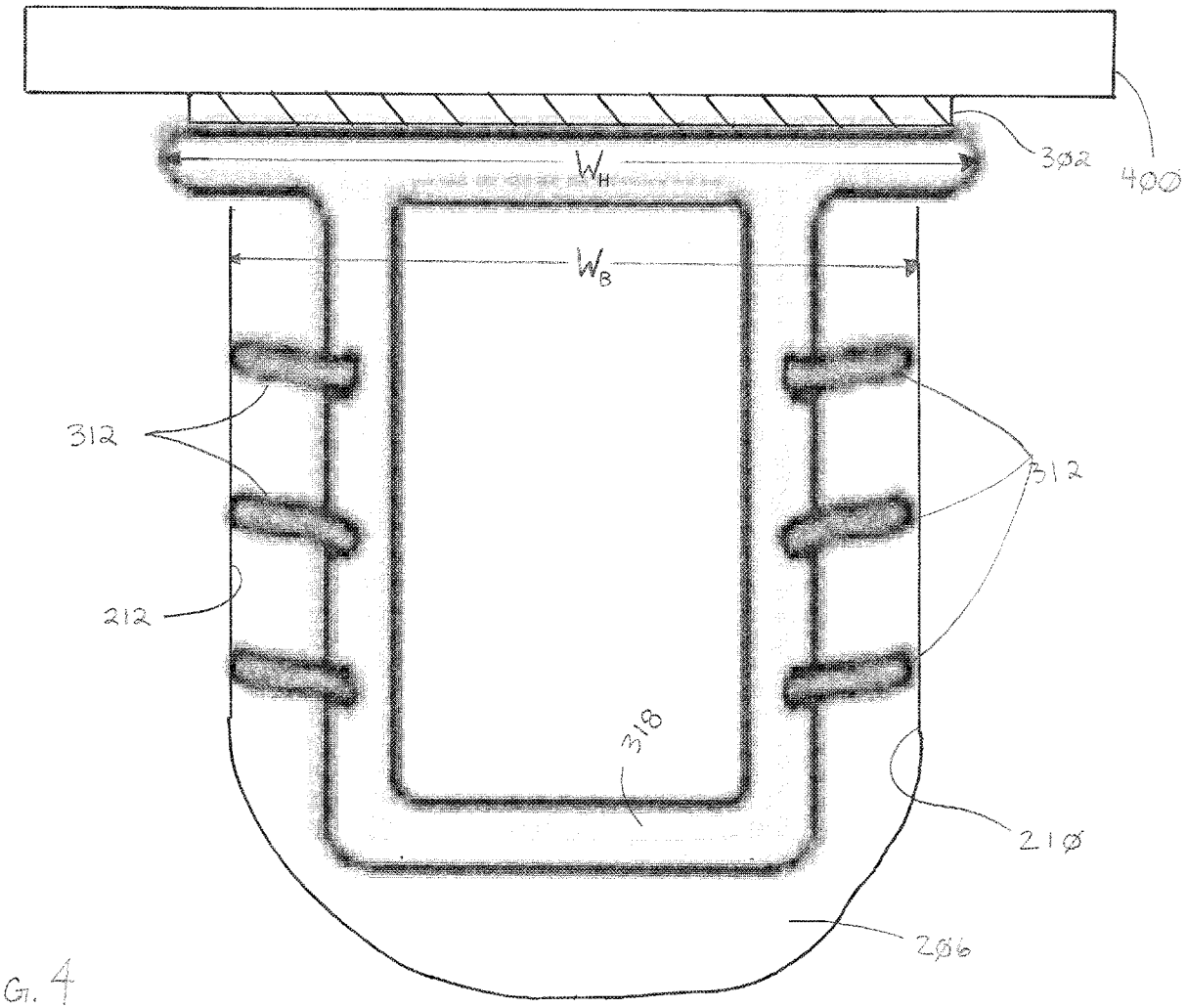
FIG. 4 is a cross sectional view of the shelf locator insert of FIG. 2 placed within the shelf support bracket and the shelf placed over the shelf locator insert, according to one or more embodiments show and described herein.

Referring to FIG. 4, a cross-sectional view of the shelf locator insert 300 within the channel 206 of the shelf support bracket 200 is shown. In embodiments, the shelf locator insert 300 is friction fit into the channel 206 of the shelf support bracket 200 that has opposing interior walls 210, 212 interfacing with the engagement fins 312, when the insertable portion 306 is inserted into the channel 206 of the shelf support bracket 200. As used herein, "friction fit" or "press fit" means a connection between the shelf locator insert 300 and the shelf support bracket 200 by friction, after the shelf locator insert 300 is pushed into the channel 206 of the shelf support bracket 200. That is, the shelf locator insert 300 may be friction fit into the channel 206 by pushing the insertable portion 306 of the shelf locator insert 300 into the channel 206. As the shelf locator insert 300 is pushed into the channel 206, the engagement fins 312 are able to bend because the engagement fins 312 may be made of a more flexible material than the insertable portion 306 or may have dimensions which allow them to bend, enabling the shelf locator insert 300 to fit into the channel 206. Further, after the shelf locator insert 300 is friction fit into the channel 206, the engagement fins 312 retain the shelf locator insert 300 within the channel 206 also due to the angle (0) and width ($W_E$) of the engagement fins 312 with respect to the central axis A. The flexible engagement fins 312 can also allow use of the shelf locator inserts 300 with various shelf support brackets having channels of different widths.

When the shelf locator insert 300 is friction fit into the channel 206, the engagement fins 312 of the shelf locator insert 300 may interface with opposing interior walls 210, 212 of the shelf support bracket 200 to fit the shelf locator insert 300 into the shelf support bracket 200. Further, when the shelf locator insert 300 is friction fit, only the insertable portion 306 of the shelf locator insert 300 is inserted into the channel 206, with the head portion 304 resting over the interior walls 210, 212 of the shelf support bracket 200. That is, the head portion 304 of the frame 314 extends over opposing interior walls 210, 212 of the shelf support bracket 200 when the insertable portion 306 is inserted into the channel 206 of the shelf support bracket 200. The head portion 304 is configured to have the head portion width ($W_H$) which is greater than a channel width ($W_B$) which extends between a first interior wall 210 and a second interior wall 212, thereby stopping the head portion 304 from entering into the channel 206. In some embodiments, the channel width ($W_B$) along the arm portion 204 of the shelf support bracket 200 may be uniform, thereby allowing the shelf locator insert 300 to be placed a different locations along the arm portion 204 of the shelf support bracket 200. In some embodiments, more than one shelf locator insert 300 may be placed within the channel 206 of the shelf support bracket 200.

FIG. 4 further depicts the shelf 400 placed over the shelf locator insert 300 that is placed within the arm portion 204 of the shelf support bracket 200, and removably attached to the shelf locator insert 300 with the tacky layer 302 of the shelf locator insert 300. To place the shelf 400 over the shelf locator insert 300, the tacky layer 302 is exposed by peeling off a protective layer, if present. The shelf 400 may be then placed over the tacky layer 302 and a suitable amount of force may be applied by the user, for example, by using his or her hands and pressing the shelf 400 downwards onto the shelf support bracket 200. The shelf 400 may be a wooden shelf, metal shelf, plastic shelf, acrylic shelf, and the like. By placing the shelf 400 over the shelf locator insert 300 that is within the channel 206 of the shelf support bracket 200, the shelf 400 is inhibited from moving forwards, backwards or side-to-side on the shelf support bracket 200. That is, due to the tacky layer 302, the shelf 400 is releasably affixed to the shelf support bracket 200 and movement between the shelf 400 and the shelf support bracket 200 is reduced or prevented, allowing the shelf 400 to firmly rest on the shelf support bracket 200 without permanently attaching the shelf 400 to the shelf support bracket 200 (e.g. by using screws, bolts and the like). To remove the shelf 400 from the shelf support bracket 200, a user may apply an upward force to remove the shelf 400 along with the shelf locator inserts 300 attached thereto from the shelf support bracket 200. Sufficient tensile force applied between the shelf locator inserts 300 and the shelf 400 can detach the shelf 400 from the tacky layer 302 of the shelf locator insert 300.

While the shelf 400 is shown to be supported with one shelf support bracket 200 having a single shelf locator insert 300 within, in embodiments, the shelf 400 may be supported by two or more shelf support brackets 200 located at opposite ends of the shelf 400. Further, each shelf support bracket 200 may have one or more shelf locator inserts 300 placed with each channel 206 to allow attachment between the shelf 400 and the shelf support bracket 200 such that forward, backward or side-to-side movement of the shelf 400 while placed on the shelf support bracket 200 is prevented.

Figure 5:
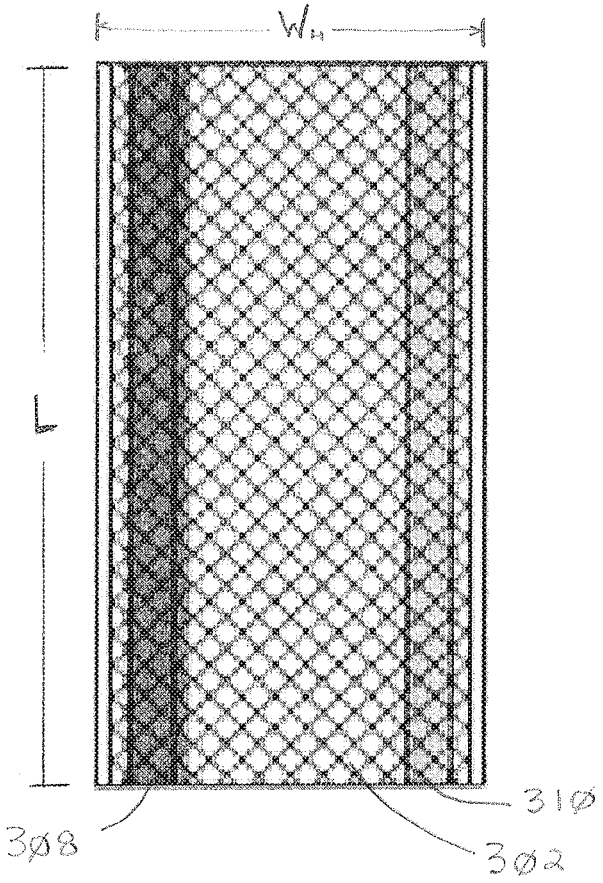
FIG. 5 depicts a top view of the shelf locator insert of FIG. 2, according to one or more embodiments shown and described herein.

Referring to FIG. 5, a top view of the shelf locator insert 300 is shown. The view depicts the head portion width ($W_H$) and the length (L) dimensions. The tacky layer 302 is depicted above the shelf locator insert 300. In some embodiments, a shelf 400 may be placed over the tacky layer 302 and a suitable amount of force may be applied by the user, for example, by using his or her hands and pressing the shelf 400 downwards onto the shelf support bracket 200. The tacky layer 302 is supported by the first leg member 308 and the second leg member 310.

Figure 6:
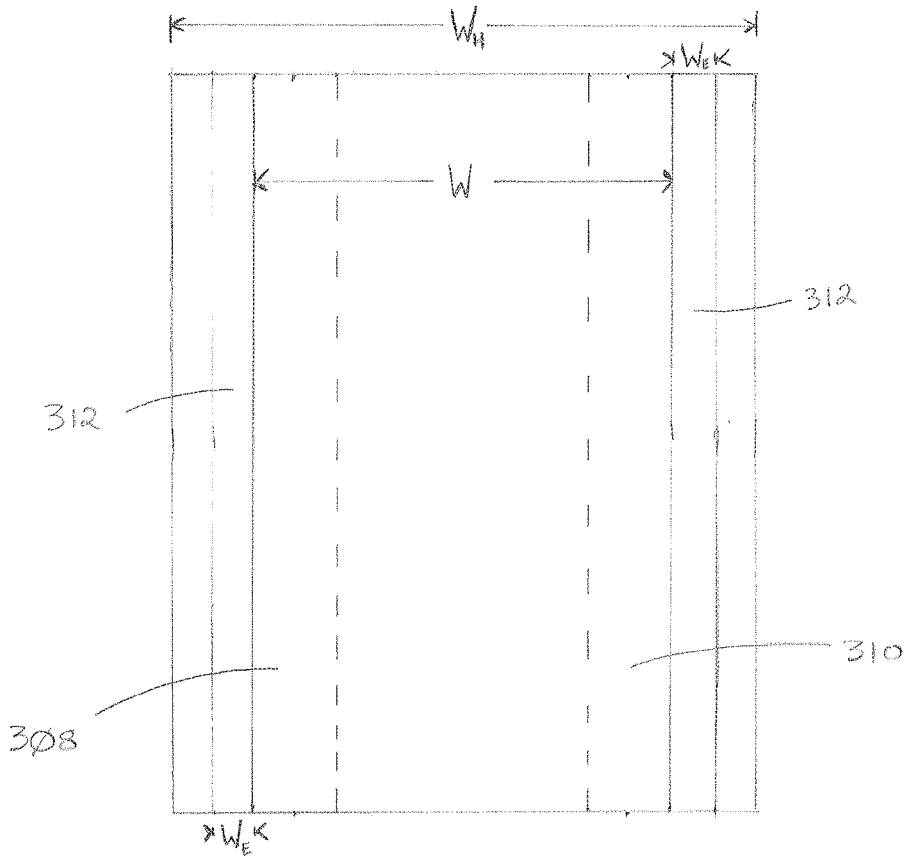
FIG. 6 depicts a bottom view of the shelf locator insert of FIG. 2, according to one or more embodiments shown and described herein.

Referring to FIG. 6, a bottom view of the shelf locator insert 300 is shown. The head portion width ($W_H$) is shown and the base member 318 having width (W) is shown. In some embodiments, the engagement fin 312 will project from both sides of the frame 314 to a width ($W_E$) of the engagement fin 312.

It should be understood that the embodiments disclosed herein include apparatus and systems for locating shelves with a shelf locator insert. The shelf locator insert includes an insertable portion having a first leg member, and a second leg member spaced apart from the first leg member, and a head portion located over the first leg member and the second leg member of the insertable portion. The shelf locator insert further includes a tacky layer located over the head portion, and an engagement fin extending along one or more of the first and second leg members. The insertable portion is configured to be received within a channel of a shelf support bracket such that the engagement fin interfaces with an interior wall of the shelf support bracket to fit the shelf locator insert into the shelf support bracket. By placing the shelf locator insert within the channel of the shelf support bracket, adjustable shelving may be obtained that removably attaches the shelf to the support bracket, and at the same time inhibits unintended movement of the shelf on the shelf support bracket.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A shelf locator insert comprising:
an insertable portion comprising a leg member;
a head portion located over the leg member;
a tacky layer located on the head portion; and
an engagement fin provided along the leg member;
wherein the insertable portion is configured to be received within a channel of a shelf support bracket such that the engagement fin interfaces with an interior wall of the shelf support bracket to friction fit the shelf locator insert in the shelf support bracket,
wherein the engagement fin is made of a different material than the leg member.

2. The shelf locator insert of claim 1, wherein the leg member is a first leg member, the insertable portion comprising a second leg member spaced from the first leg member, the head portion extends outwardly beyond the first leg member and the second leg member.

3. The shelf locator insert of claim 1, wherein the engagement fin extends at an angle (θ) to a central axis of the shelf locator insert within a range of about 45 degrees to about 85 degrees, the central axis being perpendicular to the head portion.

4. The shelf locator insert of claim 1, wherein the engagement fin is more flexible than the leg member such that the engagement fin is configured to bend relative to the leg member when the shelf locator insert is inserted into the shelf support bracket.

5. The shelf locator insert of claim 1, wherein the engagement fin extends along a length (L) of the leg member.

6. The shelf locator insert of claim 1, wherein the engagement fin and the insertable portion are coextruded.

7. The shelf locator insert of claim 1, wherein the tacky layer is an adhesive tape.

8. The shelf locator insert of claim 1, wherein a portion of the engagement fin is encapsulated within material of the leg member.

9. The shelf locator insert of claim 1 comprising multiple engagement fins extending along a length of the leg member, the engagement fins being substantially parallel to one another.

10. A shelf locating system comprising:
a shelf support bracket comprising:
a base portion for attachment with an upright support structure;
an arm portion extending from the base portion; and
a channel within the arm portion, the channel having an interior wall; and
a shelf locator insert configured to be received within the channel of the shelf support bracket, and comprising:
a frame comprising an insertable portion and a head portion located over the insertable portion;
a tacky layer located over the head portion of the frame; and
an engagement fin extending along a length of the insertable portion;
wherein the engagement fin is made of a different material than the insertable portion and interfaces with the interior wall of the shelf support bracket to fit the shelf locator insert into the channel.

11. The shelf locating system of claim 10, wherein the channel of the shelf support bracket has opposing interior walls interfacing with multiple engagement fins when the insertable portion is inserted into the channel.

12. The shelf locating system of claim 10, wherein the head portion of the frame extends over opposing walls of the shelf support bracket when the insertable portion is inserted into the channel.

13. The shelf locating system of claim 10, wherein a head portion width ($W_H$) of the head portion is greater than a channel width ($W_B$) which extends between a first interior wall and a second interior wall of the channel of the shelf support bracket.

14. The shelf locating system of claim 10, wherein multiple shelf locator inserts are insertable within the channel of the arm portion of the shelf support bracket.

15. The shelf locating system of claim 10, wherein the arm portion extends perpendicular to the base portion.

16. The shelf locating system of claim 10, wherein the engagement fin extends at an angle (θ) to a central axis of the shelf locator insert within a range of about 45 degrees to about 85 degrees, the central axis being perpendicular to the head portion.

17. The shelf locating system of claim 16, wherein the shelf locator insert is retained within the channel of the shelf support bracket due to the angle (θ) and a width ($W_E$) of the engagement fin.

18. The shelf locating system of claim 10, wherein a portion of the engagement fin is encapsulated within material of the insertable portion.

19. The shelf locating system of claim 10 comprising multiple engagement fins extending along a length of the insertable portion, the engagement fins being substantially parallel to one another.

* * * * *